US007799212B2

(12) United States Patent
Nakashima et al.

(10) Patent No.: US 7,799,212 B2
(45) Date of Patent: Sep. 21, 2010

(54) METHOD FOR PREVENTING FOULING OF A HEAT EXCHANGER FOR COOLING RESIDUE FROM A HYDRODESULFURIZATION/HYDROCRACKING PROCESS

(75) Inventors: Norihiro Nakashima, Kawasaki (JP); Masayoshi Kuwbara, Kawasaki (JP); Manabu Higo, Kawasaki (JP); Hiroyuki Kobayashi, Tokyo (JP)

(73) Assignees: Tonen General Sekiyu K.K., Tokyo (JP); Showa Shell Sekiyu K.K., Tokyo (JP); Research Association of Refinery Integration for Group Operation, Tokyo (JP)

( * ) Notice: Subject to any disclaimer, the term of this patent is extended or adjusted under 35 U.S.C. 154(b) by 112 days.

(21) Appl. No.: 11/362,520

(22) Filed: Feb. 27, 2006

(65) Prior Publication Data

US 2007/0007178 A1 Jan. 11, 2007

(30) Foreign Application Priority Data

Feb. 28, 2005 (JP) ..... 2005-054410

(51) Int. Cl.
*C10G 45/00* (2006.01)
*C10G 17/00* (2006.01)

(52) U.S. Cl. ..... 208/255; 208/48 AA; 208/48 R; 208/100; 208/107; 208/108

(58) Field of Classification Search ..... 208/48 AA, 208/48 R, 100, 107, 108, 255
See application file for complete search history.

(56) References Cited

U.S. PATENT DOCUMENTS 5,690,176 A 11/1997 Delbianco et al.
5,755,955 A * 5/1998 Benham et al. ..... 208/112
6,004,453 A 12/1999 Benhan et al.
6,485,578 B1 11/2002 Park et al.
6,972,047 B2 12/2005 Butler et al.

FOREIGN PATENT DOCUMENTS

WO WO 03/012253 A 2/2003
WO WO 03/103863 12/2003

OTHER PUBLICATIONS

Search Report for EP 06004068.

* cited by examiner

*Primary Examiner*—In Suk Bullock
*Assistant Examiner*—Prem C. Singh

(57) ABSTRACT

A method which controls sedimentation occurring at a heat exchanger for cooling hydrodesulfurization/hydrocracking residue containing asphaltenes at a high content and thereby prevents fouling of the heat exchanger is disclosed. A method for preventing fouling of a heat exchanger for cooling hydrodesulfurization/hydrocracking residue, which injects flux oil into hydrodesulfurization/hydrocracking residue containing asphaltenes at 1% by mass or more, wherein the flux oil is at least one species of residue selected from the group consisting of crude vacuum distillation residue and fluidized catalytic cracking residue, and injected into the hydrodesulfurization/hydrocracking residue to control its actual sediment content at 0.2% by mass or less, determined in accordance with IP-375 is also disclosed.

4 Claims, 5 Drawing Sheets

METHOD FOR PREVENTING FOULING OF A HEAT EXCHANGER FOR COOLING RESIDUE FROM A HYDRODESULFURIZATION/HYDROCRACKING PROCESS

CROSS REFERENCE TO RELATED APPLICATION

This application relates and claims priority to Japanese Patent Application No. JP 054410-2005, filed on Feb. 28, 2005.

FIELD OF THE INVENTION

The present invention relates to a method for preventing fouling of a heat exchanger for cooling residua from a hydrodesulfurization/hydrocracking process (hereinafter referred to as hydrodesulfurization/hydrocracking residue), more particularly a method for preventing or mitigating fouling of a heat exchanger with sediments deposited as a result of cooling of hydrodesulfurization/hydrocracking residue containing asphaltenes at a high content.

DESCRIPTION OF THE RELATED ART

A hydrodesulfurization/hydrocracking process is one of the major oil refining processes developed to treat heavy hydrocarbon oil, asphalt or the like as a feedstock under high temperature, high hydrogen pressure in the presence of a bifunctional catalyst for hydrocarbon hydrocracking and hydrogenation. It involves hydrocracking and hydrodesulfurization as the major reactions to remove impurities, e.g., sulfur, nitrogen, metals and the like, and, at the same time, to produce lighter hydrocarbon oil of desired chemical structures having intended chain lengths by converting heavy molecules into lighter molecules. It is regarded as one of the major technical means for converting heavy oil now tending to be overabound into lighter oil massively in demand. Moreover, it is useful for producing oil products well adapted for environmental preservation measures, because of its capacity of deeply removing sulfur and nitrogen.

However, it is pointed out that a hydrodesulfurization/hydrocracking process involves several major problems, e.g., decreased cracking rate in the end of catalyst life cycle, resulting from fouling caused by sediments deposited on the process equipment walls, generally occurring in a process having a fixed bed reactor. Even in a heavy oil hydrodesulfurization/hydrocracking process having an ebullated bed reactor, in which on-stream exchange of part of catalyst can be made, sedimentation-caused equipment fouling frequently limits cracking rate increase. Thus, the problems associated with sedimentation-caused equipment fouling have significant adverse effects on hydrodesulfurization/hydrocracking process economics.

Asphaltenes considered to be one of the major causes for sedimentation belong to polynuclear aromatic hydrocarbons having condensed rings, and are defined as a substance corresponding to heavy hydrocarbon insoluble in normal heptane ($nC_7$) as a paraffinic hydrocarbon compound and soluble in toluene as an aromatic hydrocarbon compound. They have a very high molecular weight, sometimes reaching around 5,000 to 40,000, and C/H ratio of around 10 or more.

Asphaltenes tend to separate out as sediments when ambient temperature decreases or mixed with oil which dissolves asphaltenes to only a limited extent (i.e., oil low in compatibility or stability with asphaltenes), e.g., saturated aliphatic hydrocarbon compounds. Asphaltenes are also known to cause sedimentation when exposed to high temperature for extended periods, because of accelerated agglomeration to increase molecular weight of molecules which tend to induce sedimentation.

Sedimentation of asphaltenes is controlled, when they are stabilized with a resin or aromatic hydrocarbon which encloses an asphaltene molecule. However, sedimentation of asphaltenes may occur to cause problems, e.g., process equipment clogging, when they are placed in an atmosphere which can destroy the stabilized conditions. In particular, changed operating conditions accompanied by cooling, e.g., those conditions observed in heat exchangers, greatly decrease asphaltene-dissolving capacity of a solvent enclosing an asphaltene molecule (i.e., solvent of maltenes) to aggravate heat exchanger clogging problems.

In particular, a hydrodesulfurization/hydrocracking process, which treats a feedstock of heavy oil, tends to provide conditions which can accelerate sedimentation, because the hydrodesulfurization/hydrocracking reactions will build up condensed or concentrated asphaltenes in the residue, and also build up aliphatic hydrocarbons converted from resins, aromatic hydrocarbons or the like.

It is actually observed in a commercial plant that sedimentation occurs as a result of cooling of asphaltene-containing hydrodesulfurization/hydrocracking residue in a heat exchanger to cause problems, e.g., increased operating and maintenance costs resulting from fouling-caused clogging of the equipment.

Under these situations, some measures have been proposed to prevent the sedimentation by adding various species of asphaltene-compatible hydrocarbon oil to asphaltene-containing hydrocarbon oil. The JP-A 8-134471 discloses a method for controlling production of dry sludge in a hydrogenation process for heavy oil, e.g., atmospheric or vacuum residue, by use of a pretreated catalyst to keep an asphaltene/resin mass ratio of 1 or less in the treated oil. This document discusses that dry sludge produced by a heavy oil hydrogenation process is mainly composed of coke-like materials resulting from asphaltenes or the like polymerized to become undispersible in oil.

U.S. Pat. No. 4,853,337 discloses a method for preventing fouling by mixing crudes of different aromatic/asphaltene ratio to control asphaltene content.

These prior art references, however, disclose techniques for treating residue from an atmospheric or vacuum distillation unit, which involves no cracking reaction, and neither disclose nor suggest solution of the problems which the present invention intends, i.e., prevention of fouling of a heat exchanger occurring when it cools heavy oil tending to cause sedimentation, e.g., hydrodesulfurization/hydrocracking residue treated under severe hydrodesulfurization/hydrocracking conditions and containing condensed polynuclear compounds at a high content by controlling sedimentation resulting from decreased temperature.

Under these situations, there are much demands for methods developed to control fouling of an heat exchanger which cools hydrodesulfurization/hydrocracking residue useful as a heavy oil feedstock for cokers or the like.

SUMMARY OF THE INVENTION

It is an object of the present invention to provide a method which can efficiently control sedimentation occurring when hydrodesulfurization/hydrocracking residue containing asphaltenes at a high content is cooled by a heat exchanger while keeping its compatibility with others, and, at the same time, can prevent fouling which limits the process operation, thereby contributing to solving fouling-caused heat changer clogging problems.

The inventors of the present invention have noted necessity for finding conditions to be set to control sedimentation, under which a heat exchanger can stably work by qualitative and quantitative analyses of highly viscous hydrodesulfurization/hydrocracking oil to identify fouling products formed in a heat exchanger where it is cooled, in order to solve the above problems. They have extensively studied stabilized operation of a heat exchanger with crude vacuum distillation residue as flux oil injected into hydrodesulfurization/hydrocracking residue at a point upstream of a heat exchanger in a commercial plant to analyze the injection effects on heat exchanger fouling rate and actual sediment content in the fluid.

Hydrodesulfurization/hydrocracking process products which can cause fouling when cooled in a heat exchanger contain asphaltenes, coke precursors and coke itself, suggesting sedimentation-caused fouling mechanisms. Observation of the heat exchanger confirms that the fouling products increasingly build up as temperature decreases, which suggests that asphaltenes highly likely separate out in the form of sediment as they are cooled. Fouling rate at the heat exchanger can be monitored by pressure drop increase rate at the heat exchanger. It is observed that injection of crude vacuum distillation residue decreases fouling rate, from +76 kPa/day to −100 kPa/day after it is injected to 10% by volume, as shown in FIG. 1. When injection of crude vacuum distillation residue is stopped, fouling rate at the heat exchanger turns upwards again to +66 kPa/day, also as shown in FIG. 1, indicating the effects of crude vacuum distillation residue for preventing fouling at the heat exchanger. Injection of crude vacuum distillation residue is found to be also effective for decreasing actual sediment content in hydrodesulfurization/hydrocracking residue leaving the heat exchanger, from 0.34 to 0.19% by mass. The SARA analysis, described below, of the hydrodesulfurization/hydrocracking residue leaving the heat exchanger confirms that injection of crude vacuum distillation residue increases a resin content in the residue by 2.2% by mass, increasing a resin/asphaltene ratio as a measure for resistance to sedimentation by 0.3. It is considered that increased content of resin, which has a high capacity of dissolving asphaltenes, improves compatibility of hydrodesulfurization/hydrocracking residue with asphaltenes to contribute to controlled sedimentation and prevented fouling at the heat exchanger, as shown in FIG. 3. Little effect is observed in an attempt of applying a general procedure which prevents fouling by giving mechanical-self-cleaning ability to the heat exchanger tubes, which indicates superiority of the chemical procedure based on the principle for improving compatibility for a heat exchanger in which sedimentation-caused fouling occurs.

The inventors of the present invention have come to conceive and achieved the present invention, based on the above findings.

The present invention provides a method for preventing fouling of a heat exchanger for cooling hydrodesulfurization/hydrocracking residue containing asphaltenes at 1% by mass or more by injecting flux oil into the residue, wherein the flux oil is at least one species of residue selected from the group consisting of crude vacuum distillation residue and residue from a fluidized catalytic cracking unit (hereinafter referred to as fluidized catalytic cracking residue), and injected into hydrodesulfurization/hydrocracking residue to control its actual sediment content at 0.2% by mass or less, determined in accordance with IP-375.

The present invention also provides a method for preventing fouling of a heat exchanger which can control the actual sediment content in the above range by injecting crude vacuum distillation residue into hydrodesulfurization/hydrocracking residue to at least 10% by volume.

The present invention also provides a method for preventing fouling of a heat exchanger which can control the actual sediment content in the above range by injecting fluidized catalytic cracking residue into hydrodesulfurization/hydrocracking residue to at least 3% by volume.

As described above, the present invention provides a method for preventing fouling of a heat exchanger under sedimentation-controlling conditions, which can control the actual sediment content at 0.2% by mass or less, determined in accordance with IP-375 by mixing hydrodesulfurization/hydrocracking residue containing asphaltenes at a high content with (a) crude vacuum distillation residue, (b) fluidized catalytic cracking residue or (c) a mixture thereof as flux oil.

The present invention further includes the following methods as the preferred embodiments:

1) The method for preventing fouling of a heat exchanger, wherein the hydrodesulfurization/hydrocracking residue is cooled by the heat exchanger to 330 to 280° C.

2) The method for preventing fouling of a heat exchanger, wherein the hydrodesulfurization/hydrocracking residue to be cooled by the heat exchanger contains asphaltenes (heavy hydrocarbon insoluble in normal heptane ($nC_7$) as a paraffinic hydrocarbon compound and soluble in toluene as an aromatic hydrocarbon compound) in the fouling products.

The present invention can prevent or mitigate fouling of a heat exchanger for cooling hydrodesulfurization/hydrocracking residue by taking the above structure. This is also described later, e.g., by EXAMPLES. As a result, it reduces fouling frequency at a heat exchanger, leading to increased profitability resulting from increased process capacity and cracking rate. Clogging of a heat exchanger is generally remedied by hydrojet cleaning of the tube bundle after it is withdrawn from the heat exchanger. The method of the present invention can reduce clogging frequency at the heat exchanger and hence cleaning cost. Therefore, the present invention can work as a measure to contribute to solving the above problems involved in a hydrodesulfurization/hydrocracking process.

DESCRIPTION OF SYMBOLS

Figure 1:
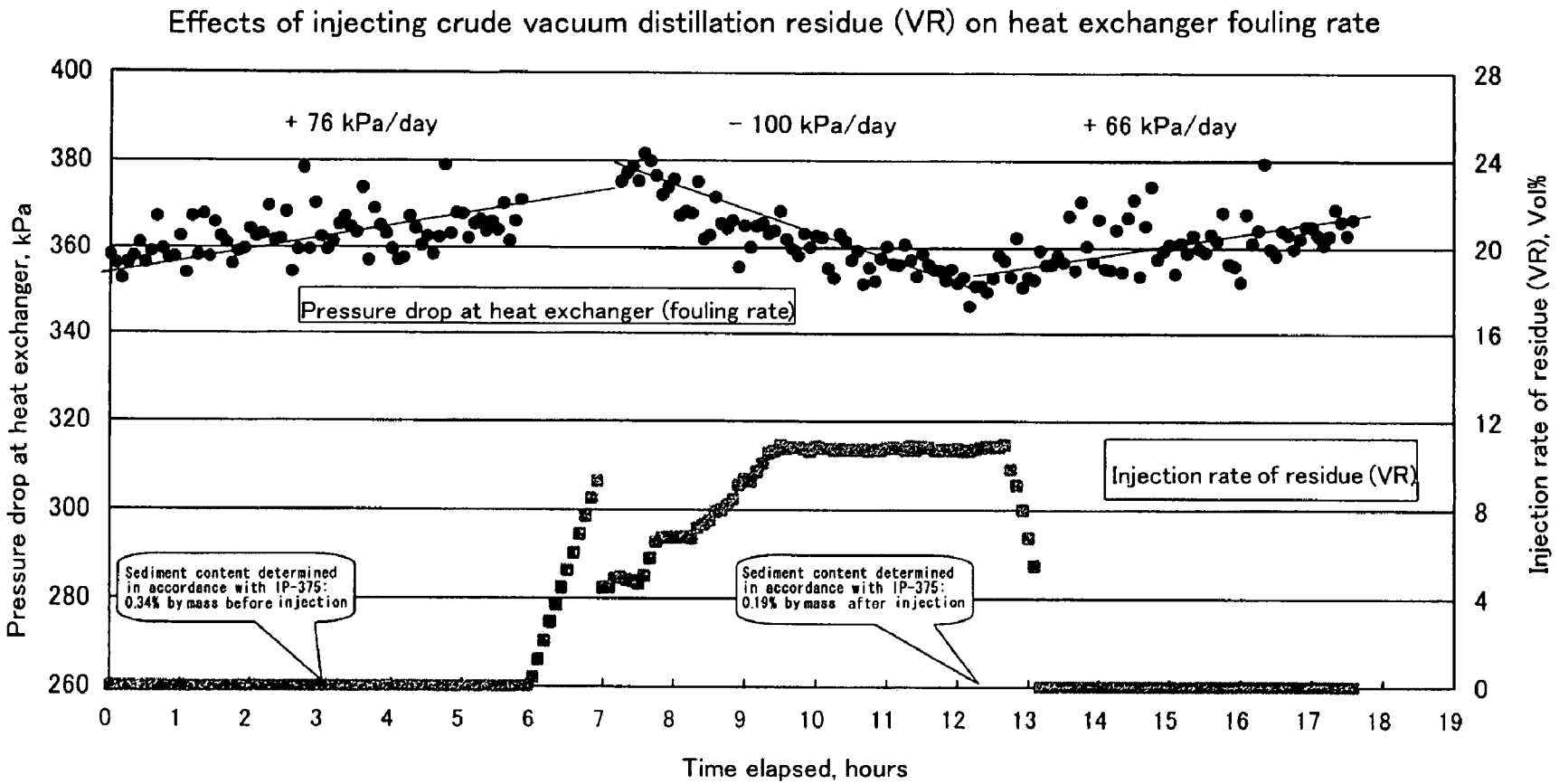
FIG. 1 shows the effects of injecting crude vacuum distillation residue (VR) on heat exchanger fouling rate, including the results produced by the present invention and comparative inventions.

| | |
|---|---|
| 1 | Hydrodesulfurization/hydrocracking residue before cooling |
| 2 | Flux oil |
| 3 | Hydrodesulfurization/hydrocracking residue after cooling |
| 4 | Heat exchanger (cooler) |

DETAILED DESCRIPTION OF THE PREFERRED EMBODIMENTS

The present invention is described in more detail. The hydrodesulfurization/hydrocracking residue which the method of the present invention treats to prevent fouling at a heat exchanger is heavy oil, e.g., residue from an atmospheric or vacuum distillation unit, processed by hydrodesulfurization/hydrocracking under high temperature and pressure in the presence of hydrogen and then by distillation to remove light and middle distillate fractions. It is a residual component boiling at around 500° C. or higher, or any component optionally separated from the above residual component.

Therefore, the hydrodesulfurization/hydrocracking residue contains asphaltenes at a high content, and the asphaltenes are high in condensation degree. It has a composition which easily causes sedimentation, because it undergoes severe cracking reactions which massively decompose aromatic hydrocarbon compounds into saturated aliphatic hydrocarbon compounds. It is confirmed by the SARA analysis conducted by the inventors that the hydrodesulfurization/hydrocracking residue contains saturates, aromatics, resins and asphaltenes, with saturate and asphaltene contents increasing while aromatic and resin contents decreasing as a result of hydrodesulfurization/hydrocracking, as discussed in EXAMPLES.

The hydrodesulfurization/hydrocracking residue which the method of the present invention treats to prevent fouling at a heat exchanger contains asphaltenes at 1% by mass or more, more specifically some containing at as high as around 15% by mass. However, the present invention is not limited by asphaltene content.

The hydrodesulfurization/hydrocracking residue which the method of the present invention treats is cooled by a heat exchanger. The cooling method, however, is not limited, and does not exclude any other method accompanied by cooling of the residue.

The heat exchanger for which the present invention is applied to prevent fouling preferably has a cooler structure for cooling hydrodesulfurization/hydrocracking residue of high temperature. It has a structure for heat exchanging across heat transfer walls, e.g., tubular exchanger, coil type exchanger or double-tube type exchanger.

The hydrodesulfurization/hydrocracking residue to which the method of the present invention is applied for preventing fouling may be from a paraffinic, naphthenic crude or a mixture thereof. More specifically, it may be from a Middle East crude. The hydrodesulfurization/hydrocracking process for treating the residue feedstock is not limited. It may be a fixed bed, ebullated bed or slurry phase process.

It is important for the present invention to set heat exchanger inlet temperature for prevention of coking and also to set sedimentation-controlling conditions for hydrodesulfurization/hydrocracking residue containing asphaltenes at a high content. These conditions are described later in detail.

Prevention of coking: Thermal cracking and polycondensation of hydrodesulfurization/hydrocracking residue will be accelerated when it is exposed to a very high temperature, e.g., 350° C. or higher, possibly to produce coke precursor or coke. When these coky substances are formed at a heat exchanger or the like, a fouling controlling effect will be no longer expected, because they scarcely dissolve hydrocarbon. Therefore, it is important to set inlet temperature of a heat exchanger or the like for hydrodesulfurization/hydrocracking residue at 350° C. or lower. This is the first condition for the present invention.

Controlling of fouling: It is preferable to control actual sediment content at 0.2% by mass or less, determined in accordance with IP-375, to prevent fouling at a heat exchanger. This is the second condition for the present invention. It is confirmed that fouling of a heat exchanger in a commercial plant can be prevented when hydrodesulfurization/hydrocracking residue has an actual sediment level controlled in the above range, even when it is cooled at the heat exchanger.

The above sediment level can be achieved, efficiently and without bringing significant impacts on mixed oil properties, by mixing hydrodesulfurization/hydrocracking residue with flux oil. Some flux oils useful for the present invention include crude vacuum distillation residue, fluidized catalytic cracking residue and a mixture thereof.

Crude vacuum distillation residue is residue of atmospheric distillation residue which is treated by a vacuum distillation plant to distill off distillates, e.g., vacuum gas oil, boiling at around 540° C. or lower. Type of residue as flux oil is not limited. Residue contains saturates, aromatics, resins and asphaltenes according to the SARA analysis, and preferably has a lower saturate and asphaltene content and higher aromatic and resin content than hydrodesulfurization/hydrocracking residue with which it is to be mixed. Type of crude is also not limited. It may be the one from which the hydrodesulfurization/hydrocracking residue is produced. More specifically, a Middle East crude may be used, after it is treated by a vacuum distillation plant under normal conditions to produce residue having the boiling range described above. Moreover, two or more types of vacuum distillation residue of different properties, e.g., density, boiling range or composition, may be also used.

Fluidized catalytic cracking residue is residue from a fluidized catalytic cracking plant, which treats a feedstock selected from a wide range from vacuum distillate to atmospheric residue in the presence of a solid acidic catalyst, e.g., zeolite catalyst. It is residue (boiling range: around 350° C. or higher) from a fluidized catalytic cracking effluent stream, which is treated to distill off cracked fractions beginning with a gasoline fraction. It contains aromatics at a particularly higher content than hydrodesulfurization/hydrocracking residue although containing saturates, according to the SARA analysis.

Type of crude is not limited for fluidized catalytic cracking residue, as is the case with hydrodesulfurization/hydrocracking residue or atmospheric residue. It may be a paraffinic, naphthenic crude or a mixture thereof. Fluidized catalytic cracking residue may be any residue from any type of fluidized catalytic cracking plant. However, it preferably contains aromatics at a high content. More specifically, one from a Middle East crude is suitable. Moreover, two or more types of fluidized catalytic cracking residue of different properties, e.g., density, boiling range or composition, may be also used.

A required ratio of flux oil to hydrodesulfurization/hydrocracking residue increases as cooling temperature decreases. It is at least 10% by volume with crude vacuum distillation residue and 3% by volume with fluidized catalytic cracking residue to secure a sediment content at 0.2% by mass, determined by IP-375.

Fluidized catalytic cracking residue can be cited as particularly suitable flux oil, as discussed later in EXAMPLES. Another residue component produced by a refinery, chemical plant or the like can be also used as flux oil as an equivalent of fluidized catalytic cracking residue or the like, so long as it can control the sediment content.

Table 1 shows typical properties of hydrodesulfurization/hydrocracking residue, crude vacuum distillation residue and fluidized catalytic cracking residue. It can be understood that hydrodesulfurization/hydrocracking residue contains asphaltenes at a higher content than other residue types.

Table 2 shows some results of analysis of products which can foul a heat exchanger for cooling hydrodesulfurization/hydrocracking residue. As shown, the fouling product contains asphaltenes (insoluble in normal heptane ($nC_7$) and soluble in toluene) at around 3 to 18% by mass and coke precursor (insoluble in toluene and soluble in quinoline) at around 40 to 75% by mass, suggesting a sediment-caused fouling mechanism.

Moreover, the fouling products increasingly build up as temperature decreases in a heat exchanger, as confirmed by observation of the disassembled exchanger, which suggests that asphaltenes highly likely separate out in the form of sediment as they are cooled.

FIG. 1 shows a trend of pressure drop at a heat exchanger, when crude vacuum distillation residue is injected into hydrodesulfurization/hydrocracking residue at a point upstream of the heat exchanger. Fouling rate at a heat exchanger can be monitored by pressure drop increase rate at the heat exchanger. The pressure drop depends on flow rate of hydrodesulfurization/hydrocracking residue to be cooled by a heat exchanger, so long it has constant properties. The pressure drop at a heat exchanger, shown in FIG. 1, is a level adjusted as the one at a constant flow rate of 70 kL/hour.

The fouling rate is +76 kPa/day before no crude vacuum distillation residue is injected, but decreases to −100 kPa/day after it is injected to 10% at a point upstream of the heat exchanger. It turns upwards again to +66 kPa/day, when the injection is stopped. It is thus confirmed that injection of crude vacuum distillation residue is effective for preventing fouling at the heat exchanger.

It is understood, as shown in FIG. 1, that the heat exchanger tends to foul while the pressure drop is increasing, the fouling tendency increasing as the pressure drop increase rate increases.

The pressure drop at the heat exchanger is shown by a solid circle in FIG. 1, and the level is given on the left ordinate axis. The crude vacuum distillation residue injection rate, % by volume based on hydrodesulfurization/hydrocracking residue to be cooled by the heat exchanger, is given on the right ordinate axis.

Figure 2:
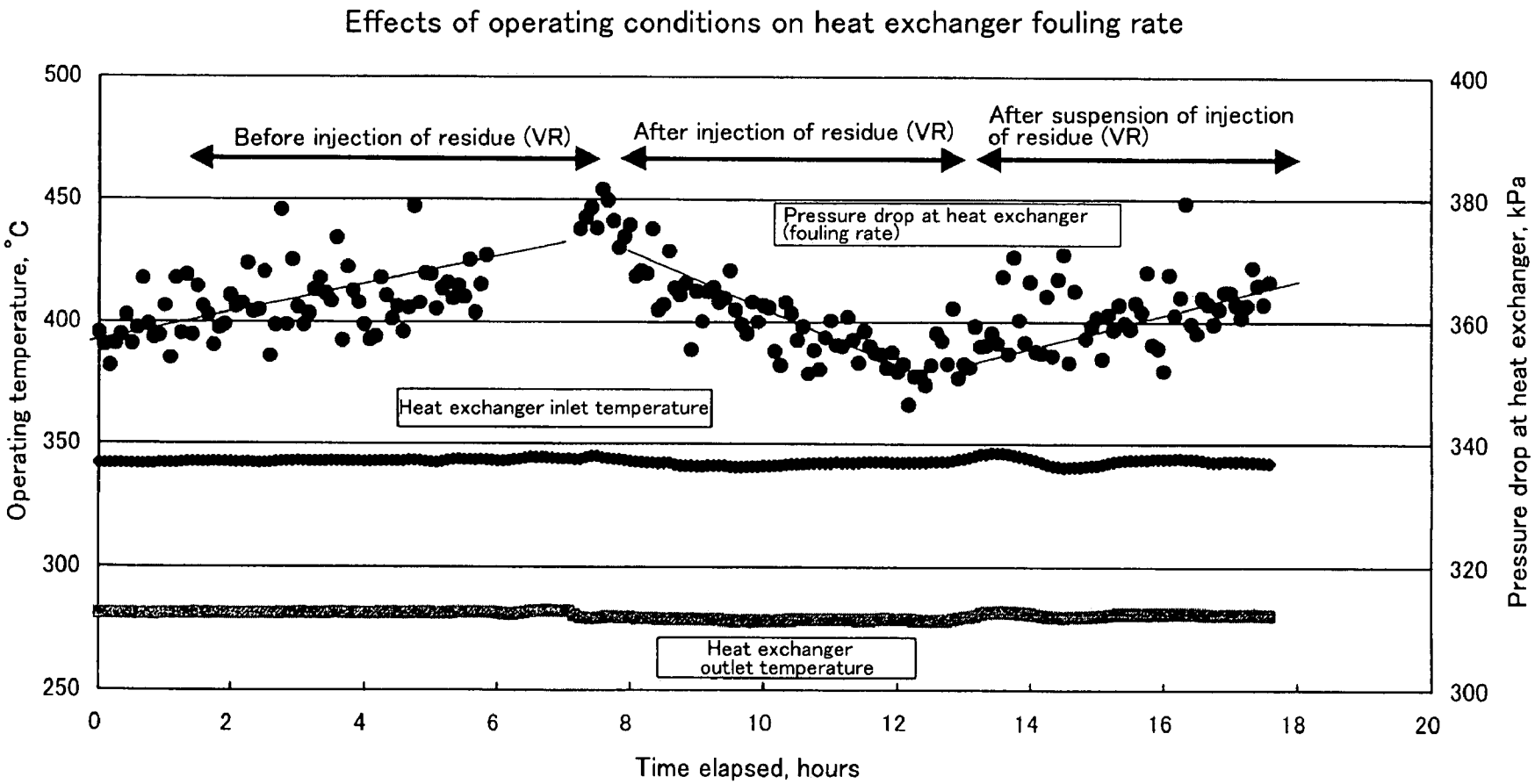
FIG. 2 shows the effects of operating conditions on heat exchanger fouling rate, including the results produced by the present invention and comparative inventions.

FIG. 2 shows a trend of heat exchanger operating temperature, when crude vacuum distillation residue is injected into hydrodesulfurization/hydrocracking residue at a point upstream of the heat exchanger. Temperature at the heat exchanger inlet is around 340° C., lower than 350° C. at which coking notably occurs, but around 280° C. at the outlet, a sufficiently low level to cause separation of asphaltenes.

The heat exchanger inlet and outlet temperature trends are given on the left ordinate axis in FIG. 2, and the pressure drop at the heat exchanger is given on the right ordinate axis, as is the case with FIG. 1.

Table 3 and FIG. 1 show the analytical results of actual sediment content in the residue at the outlet of the heat exchanger for cooling hydrodesulfurization/hydrocracking residue, when crude vacuum distillation residue is injected into the hydrodesulfurization/hydrocracking residue at a point upstream of the heat exchanger. As shown, injection of crude vacuum distillation residue decreases the actual sediment content from 0.34% by mass before the injection to 0.19% by mass. It is thus confirmed that injection of crude vacuum distillation residue as flux oil is effective for decreasing actual sediment content in hydrodesulfurization/hydrocracking residue and can prevent fouling at the heat exchanger.

An attempt was made to prevent fouling by a mechanical self-cleaning effect by springs provided in the heat exchanger, which vibrate tubes on an on-stream basis. This mechanical procedure is most commonly used for cleaning a shell-and-tube heat exchanger, and differs from the present invention, which is based on improved compatibility.

Figure 3:
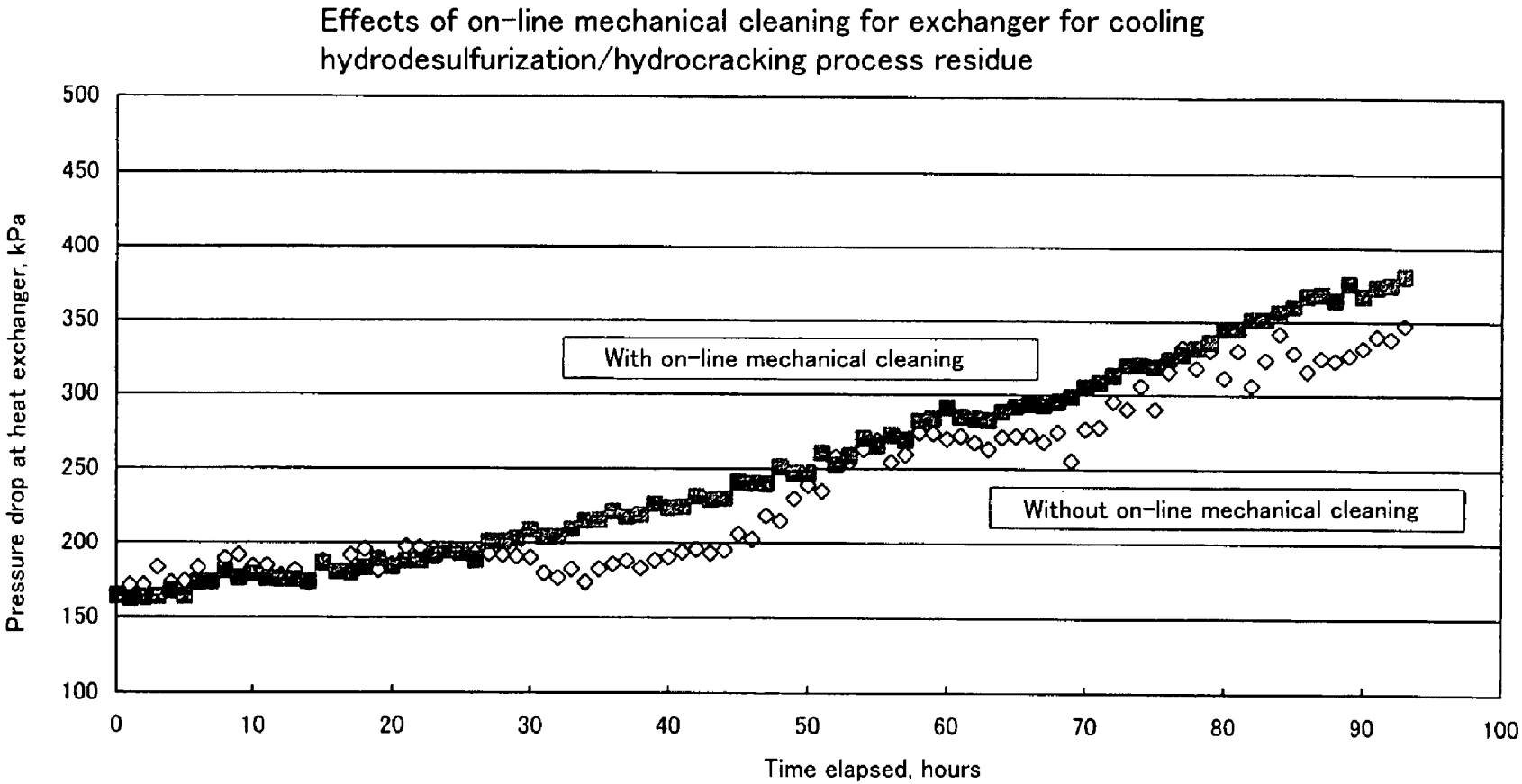
FIG. 3 shows the effects of on-line mechanical cleaning on heat exchanger fouling rate.

FIG. 3 shows the pressure drop trends at the heat exchanger for cooling hydrodesulfurization/hydrocracking residue with and without an on-line mechanical cleaning device (which tries to prevent fouling by springs provided in the heat exchanger, which vibrate the tubes on an on-stream basis to produce a mechanical self-cleaning effect).

Little effect is observed in an attempt of applying the mechanical self-cleaning procedure for the heat exchanger for cooling hydrodesulfurization/hydrocracking residue. This confirms superiority of the present invention, which is based on improved compatibility, for a heat exchanger in which sedimentation-caused fouling occurs.

EXAMPLES

The present invention is described in more detail by EXAMPLES and COMPARATIVE EXAMPLES. However, it is to be understood that the present invention is not limited by EXAMPLES or the like.

Table 1 shows properties of the hydrodesulfurization/hydrocracking residue, crude vacuum distillation residue and fluidized catalytic cracking residue used in EXAMPLES or the like. The asphaltene content, sediment content and other properties were analyzed by the following testing methods.

Table 2 shows the results of analysis of the fouling products collected when the heat exchanger for cooling hydrodesulfurization/hydrocracking residue was disassembled.

TABLE 1

| Residue properties | | | |
|---|---|---|---|
| | Hydrodesulfurization/hydrocracking residue | Crude vacuum distillation residue | Fluidized catalytic cracking residue |
| Density (kg/m$^3$) | 1052 | 1021 | 1050 |
| Saturates (% by mass) | 20.9 | 16.2 | 32 |
| Aromatics (% by mass) | 45.1 | 50.3 | 55 |
| Resins (% by mass) | 19.5 | 24.2 | 9 |
| Asphaltenes (% by mass) | 13.9 | 5.9 | 0 |
| Resin/asphaltene ratio (by mass) | 1.40 | 4.10 | — |
| Actual sediment (% by mass) | 0.34 | 0.00 | 0.00 |

Analysis of Asphaltenes

Asphaltene content was determined in accordance with JPI-55-22-83 "Composition Analysis of Asphalt by Column Chromatography" specified by Japan Petroleum Institute (JPI). This method isolates saturates, aromatics, resins and asphaltenes from a sample by column chromatography with alumina as a filler to determine their contents. Asphaltene content can be also determined by a simplified method where hydrocarbons insoluble in $nC_7$ and soluble in toluene are regarded as asphaltenes.

Analysis of Sediment

Sediment content was determined in accordance with IP-375 (ISO 10307-1) specified by the Institute of Petroleum. This method filters around 1 g of sample at 200° C. and 40 kPa, where a glass fiber filter (1.6 μm) is set in the filter after being weighed on a dry basis, to determine a sediment content (% by mass) by difference of the glass fiber filter mass before and after filtration.

Analysis of SARA (Saturate/Aromatic/Resin/Asphaltene Contents

Figure 5:
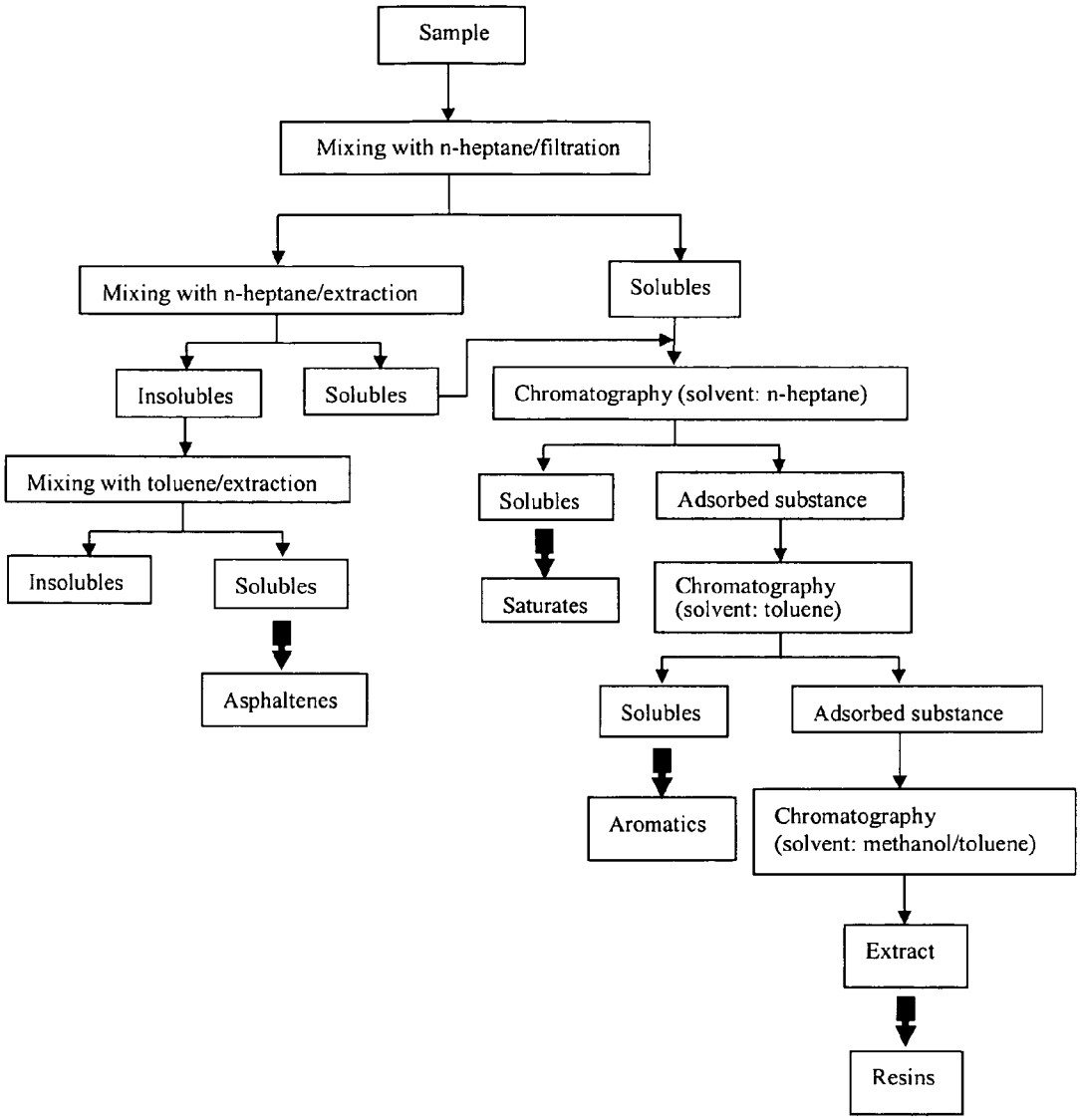
FIG. 5 is a system diagram for determining SARA content.

SARA contents were determined in accordance with JPI-55-22-83 "Composition Analysis of Asphalt by Column Chromatography" specified by Japan Petroleum Institute (JPI). This method isolates saturates, aromatics, resins and asphaltenes from a sample by column chromatography with alumina as a filler to determine their contents (Refer to FIG. 5).

Example 1

Figure 4:
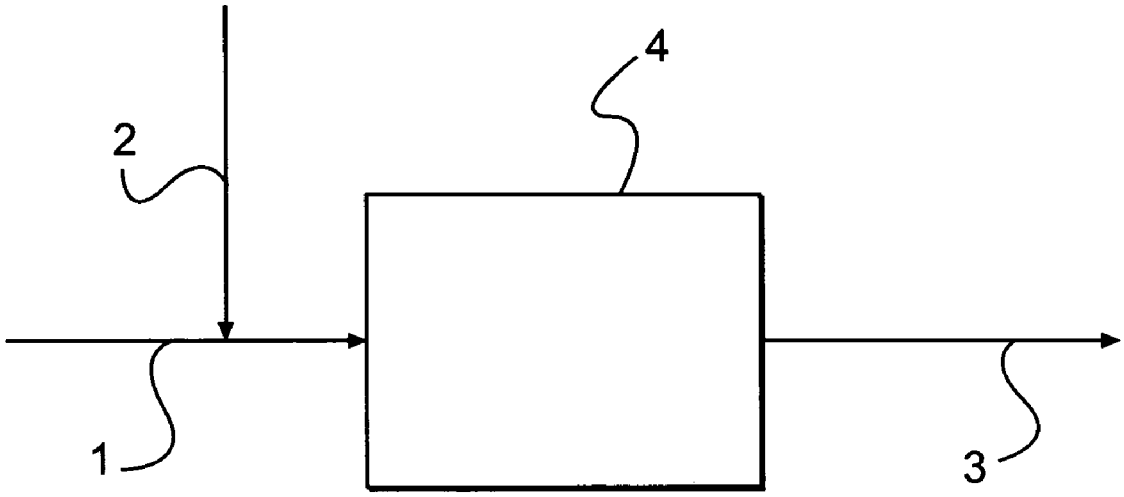
FIG. 4 illustrates a method for injecting flux oil into hydrodesulfurization/hydrocracking residue for the present invention.

Crude vacuum distillation residue was injected at a point upstream of a heat exchanger for cooling hydrodesulfurization/hydrocracking residue to 10% by volume (refer to FIG. 4), and FIG. 1 shows fouling rate at the heat exchanger. The fouling rate was +76 kPa/day before the injection, which turned downwards to −100 kPa/day after crude vacuum distillation residue was injected. Table 3 show the analytical results of actual sediment content and SARA contents in the hydrodesulfurization/hydrocracking residue, sampled at the heat exchanger outlet. The actual sediment content was 0.34% by mass before the injection and decreased to 0.19% by mass after the injection. It is thus confirmed that injection of crude vacuum distillation residue is effective for controlling sediment content in hydrodesulfurization/hydrocracking residue.

Injection of crude vacuum distillation residue also increases resin content in the residue, increasing a resin/asphaltene mass ratio as a measure for resistance to sedimentation from 1.4 to 1.7, as confirmed by the SARA analysis of the hydrodesulfurization/hydrocracking residue, collected at the heat exchanger outlet. It is considered that increased content of resin, which has a high capacity of dissolving asphaltenes, improves compatibility of hydrodesulfurization/hydrocracking residue with asphaltenes to contribute to controlled sedimentation and prevented fouling at the heat exchanger.

TABLE 2

Results of analysis of products which can foul a heat exchanger for cooling hydrodesulfurization/hydrocracking residue

| | Sample No. | | |
|---|---|---|---|
| | 1 | 2 | 3 |
| $nC_7$-solubles (% by mass) | — | 22.1 | 24.9 |
| Analysis of $nC_7$-insolubles | | | |
| Toluene-solubles (% by mass) | 3.1 | 17.9 | 5.9 |
| Quinoline-solubles (% by mass) | 75.6 | 39.7 | 56.0 |

TABLE 2-continued

Results of analysis of products which can foul a heat exchanger for cooling hydrodesulfurization/hydrocracking residue

| | Sample No. | | |
|---|---|---|---|
| | 1 | 2 | 3 |
| Carbon (% by mass) | 82.9 | 69.3 | 82.3 |
| Sulfur (% by mass) | 5.5 | 5.5 | 5.0 |
| Iron (% by mass) | 4.1 | 3.3 | 2.6 |
| Aluminum (% by mass) | 0.5 | 5.1 | 0.9 |

Comparative Example 1

The fouling rate at heat exchanger for cooling hydrodesulfurization/hydrocracking residue was +66 to +76 kPa/day, when no crude vacuum distillation residue was injected, as shown in FIG. 1. The hydrodesulfurization/hydrocracking operating conditions including feedstock properties (crude composition) were constant, and heat exchanger operating temperature was essentially constant before and after the injection, as shown in FIG. 2.

Moreover, the actual sediment content in the residue, collected at the heat exchanger outlet, was high at 0.34% by mass, failing to attain the 0.2% by mass level required for preventing fouling. The hydrodesulfurization/hydrocracking residue before the injection had a lower resin content and resin/asphaltene mass ratio than that after the injection by 2.2% by mass and 0.3, respectively.

These results indicate that content of resin, which has a high capacity of dissolving asphaltenes, in hydrodesulfurization/hydrocracking residue is insufficient for improving compatibility in the absence of crude vacuum distillation residue, which causes sedimentation and accompanied fouling at the heat exchanger, hampering its stable operation.

TABLE 3

Properties of hydrodesulfurization/hydrocracking residue before and after injection of crude vacuum distillation residue

| | Before injection (1) | After injection (2) | Difference (2 − 1) |
|---|---|---|---|
| Injection rate of crude vacuum distillation residue (% by volume) | 0 | 10 | 10 |
| Fouling rate at heat exchanger (kPa/day) | 76 | −100 | |
| Properties of residue collected at the heat exchanger outlet | | | |
| Density (kg/m$^3$) | 1051 | 1043 | −8 |
| Actual sediment (% by mass), determined by IP-375 | 0.34 | 0.19 | −0.15 |
| Saturates (% by mass) | 20.9 | 20.2 | −0.7 |
| Aromatics (% by mass) | 45.1 | 45.0 | −0.1 |
| Resins (% by mass) | 19.5 | 21.7 | 2.2 |
| Asphaltenes (% by mass) | 13.9 | 12.8 | −1.1 |
| Resin/asphaltene ratio (by mass) | 1.40 | 1.70 | 0.3 |

Comparing the results of EXAMPLE 1 with those of COMPARATIVE EXAMPLE 1, the actual sediment content in the residue collected at the heat exchanger outlet in EXAMPLE 1 attains a level of 0.2% by mass, whereas it is 0.34% by mass in COMPARATIVE EXAMPLE 1, representing a significant difference between them.

Comparative Example 2

An attempt was made to prevent fouling by a mechanical self-cleaning effect by springs provided in the heat exchanger, which vibrate the tubes on an on-stream basis. This mechanical procedure is most commonly used for cleaning a shell-and-tube heat exchanger, and differs from the present invention, which is based on improved compatibility.

FIG. 3 shows the pressure drop trends at the heat exchanger for cooling hydrodesulfurization/hydrocracking residue with and without an on-line mechanical cleaning device. Little fouling prevention effect by the mechanical cleaning is observed, because the pressure drop increase remains essentially constant whether the mechanical cleaning device is provided or not. These results confirm superiority of the present invention, which is based on the chemical procedure for improving compatibility, for a heat exchanger in which sedimentation-caused fouling occurs.

The present invention can prevent or mitigate fouling of a heat exchanger for cooling hydrodesulfurization/hydrocracking residue containing asphaltenes at a high content. It is very useful for the oil industry and greatly contributes to environmental preservation, because it can contribute to prevention of heat exchanger clogging, allow continuous, efficient operation of a hydrodesulfurization/hydrocracking process, and facilitate treatment of hydrodesulfurization/hydrocracking residue.

What is claimed is:

1. A method for preventing fouling of a heat exchanger for cooling a hydrodesulfurization/hydrocracking residue, comprising:

providing a hydrodesulfurization/hydrocracking residue containing asphaltenes at 1% by mass or more, feeding the residue into the heat exchanger for cooling the residue, wherein the heat exchanger is operated at a temperature of 350° C. or lower at the inlet of the heat exchanger, and injecting a flux oil into the residue before the residue enters the heat exchanger, wherein the flux oil is at least one species of residue selected from the group consisting of crude vacuum distillation residue and fluidized catalytic cracking residue, and wherein the flux oil is injected into the residue to control actual sediment content at 0.2% by mass or less.

2. The method according to claim 1, wherein the flux oil is crude vacuum distillation residue and is injected into the hydrodesulfurization/hydrocracking residue to at least 10% by volume.

3. The method according to claim 1, wherein the flux oil is fluidized catalytic cracking residue and is injected into the hydrodesulfurization/hydrocracking residue to at least 3% by volume.

4. The method according to claim 1, wherein the flux oil includes a crude vacuum distillation residue, which is injected into the residue to at least 10% by volume, and a fluidized catalytic cracking residue, which is injected into the residue to at least 3% by volume.

* * * * *